US009993096B2

(12) United States Patent
Frimerman

(10) Patent No.: US 9,993,096 B2
(45) Date of Patent: Jun. 12, 2018

(54) SYSTEM AND METHOD FOR TREATING HICCUPS

(71) Applicant: Bruce D. Frimerman, Minneapolis, MN (US)

(72) Inventor: Bruce D. Frimerman, Minneapolis, MN (US)

( * ) Notice: Subject to any disclaimer, the term of this patent is extended or adjusted under 35 U.S.C. 154(b) by 600 days.

(21) Appl. No.: 13/838,920

(22) Filed: Mar. 15, 2013

(65) Prior Publication Data

US 2014/0276383 A1 Sep. 18, 2014

(51) Int. Cl.
*A47G 19/22* (2006.01)

(52) U.S. Cl.
CPC ..... *A47G 19/2266* (2013.01); *Y10T 29/49826* (2015.01)

(58) Field of Classification Search
CPC ..... A47G 19/2266; Y10T 29/49826; C02F 1/003
USPC ..... 210/764, 464, 466–470, 472–475, 282, 210/455; 220/711, 713, 719
See application file for complete search history.

(56) References Cited

U.S. PATENT DOCUMENTS 4,084,330 A 4/1978 Fraser
4,617,120 A 10/1986 Barzuza et al.
4,915,835 A 4/1990 Barzuza et al.
4,999,109 A 3/1991 Sabre
5,045,195 A * 9/1991 Spangrud ..... C02F 1/002 210/266
5,190,643 A 3/1993 Duncan et al.
5,297,895 A 3/1994 Johnson
5,363,745 A 11/1994 Lin
5,478,586 A 12/1995 Connor
5,861,022 A 1/1999 Hipskind
5,888,392 A 3/1999 Frizell
6,152,953 A 11/2000 Hipskind
6,440,302 B1 8/2002 Leipziger
6,702,145 B2 * 3/2004 Malcolm ..... B65D 47/06 220/713
7,032,507 B2 * 4/2006 Cai ..... A47J 27/2105 99/317
7,062,320 B2 6/2006 Ehlinger, Jr.
7,284,676 B2 10/2007 Dantani
7,810,651 B2 10/2010 Miga, Jr.
2002/0088745 A1 * 7/2002 Barlow ..... C02F 1/002 210/266

(Continued)

FOREIGN PATENT DOCUMENTS

WO WO 2012/037296 A1 3/2012

OTHER PUBLICATIONS

PCT/US2014/025327, filed Mar. 13, 2014, Notification of Transmittal of the International Search Report and the Written Opinion dated Jul. 4, 2014, 13 pages.

(Continued)

*Primary Examiner* — Madeline Gonzalez
(74) *Attorney, Agent, or Firm* — Patterson Thuente Pedersen, P.A.

(57) ABSTRACT

The present invention relates generally to a treatment for hiccups. A device for treating hiccups utilizes a replaceable filter through which liquid must be manually drawn by a vacuum force created with the user's mouth and through which liquid will not naturally flow due to the effects of gravity. The user's draws the liquid through the filter in this manner and swallows, which eliminates the user's hiccups.

16 Claims, 6 Drawing Sheets

(56) References Cited

U.S. PATENT DOCUMENTS

| | | | | |
|---|---|---|---|---|
| 2002/0108394 | A1 | 8/2002 | Holley, Jr. | |
| 2003/0010726 | A1* | 1/2003 | Zins | B01D 46/0028 210/767 |
| 2003/0029699 | A1 | 2/2003 | Stoner | |
| 2004/0168957 | A1 | 9/2004 | Tsataros et al. | |
| 2004/0256269 | A1 | 12/2004 | Gleichauf et al. | |
| 2005/0044619 | A1 | 3/2005 | Mattson, Jr. et al. | |
| 2005/0051476 | A1* | 3/2005 | Chen et al. | 210/436 |
| 2005/0080458 | A1 | 4/2005 | Ehlinger, Jr. | |
| 2006/0102008 | A1 | 5/2006 | Lin | |
| 2007/0240580 | A1 | 10/2007 | Lusareta et al. | |
| 2011/0278216 | A1* | 11/2011 | Hull | A47G 19/2266 210/236 |
| 2012/0060850 | A1 | 3/2012 | Ray | |
| 2012/0223089 | A1 | 9/2012 | Moore | |

OTHER PUBLICATIONS

"Coffee Filter," Webpage Printout from Wikipedia, Aug. 30, 2017, 2 pages.

"Mixtures and Solutions," Webpage Printout from Science Curriculum Support Project, Princeton University, retrieved Sep. 20, 2017, 1 page.

"The Reality of Coffee Filters for Preparedness Uses," Webpage Printout from The Survival Mom, Author Rob Hanus, Jul. 8, 2014, 18 pages.

* cited by examiner

Fig. 4A
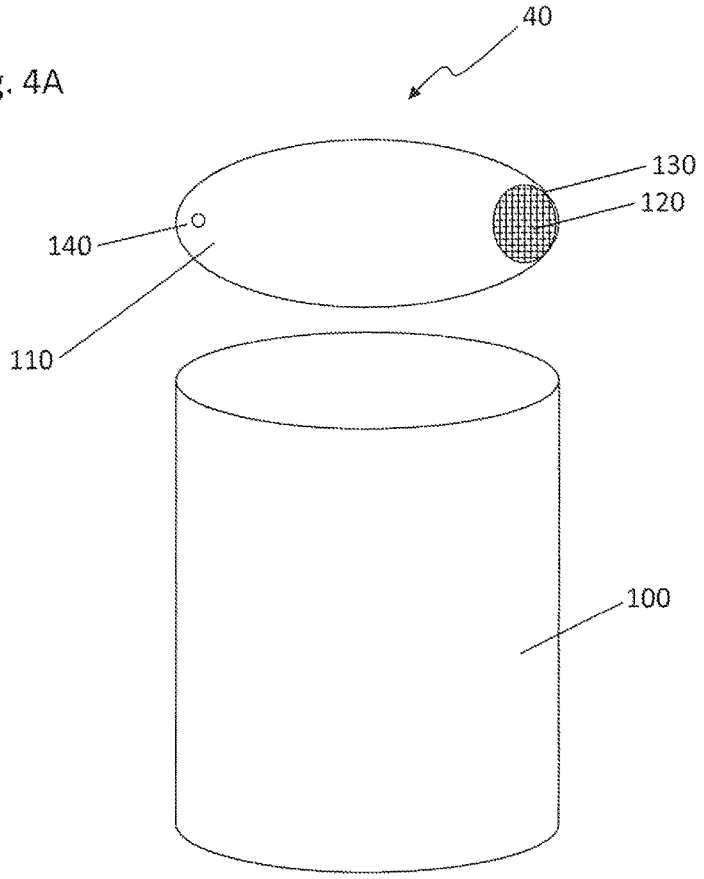
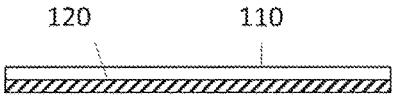
Fig. 4B
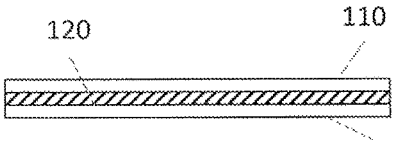
Fig. 4C

SYSTEM AND METHOD FOR TREATING HICCUPS

FIELD OF THE INVENTION

The present invention generally relates to the treatment of hiccups and, more particularly, to a system and method for treating hiccups wherein a liquid is manually drawn into a user's mouth through a filter.

BACKGROUND OF THE INVENTION

Hiccups are a condition that affects everyone. A person can suffer from hiccups for minutes, hours, or even days. At the least, hiccups can be an annoyance and may cause a person to feel embarrassed. But often times, hiccups can have severe debilitating affects on a person's life and the ways in which he or she interacts with others. They can negatively impact a person's productivity and lead to feelings of anxiety and depression. If they persist for months, hiccups can even result in malnutrition and exhaustion. Although the exact etiology of hiccups has not yet been determined, it is generally accepted that hiccups involve involuntary contractions of the diaphragm. Each contraction is followed by a sudden closure of the vocal cords, which products the characteristic "hic" sound. Hiccups can result from the consumption of a large meal, alcoholic beverages, or sudden excitement. In some cases, hiccups may be indicative of an underlying medical condition. Numerous medical remedies exist for the treatment of hiccups, including pharmaceutical intervention and surgery. Additionally, non-invasive treatments have also been successful for treating hiccups. However, there is no universally effective treatment for hiccups, and each method carries with it advantages and disadvantages.

For example, drugs that inhibit proton pumps, such as baclofen, chlorpromazine, metoclopramide, and gabapentin, have been found to eliminate the hiccups. In some cases, treatment simply involves increasing the partial pressure of carbon dioxide and inhibiting diaphragm activity by holding one's breath or rebreathing into a paper bag. In other cases, vagus nerve stimulation can eliminate hiccups. This can be done by irritating the pharynx by swallowing dry bread or crushed ice, by applying traction to the tongue, or by stimulating the gag reflex. In still other cases, the phrenic nerve can be blocked temporarily using an injection of 0.5% procaine, or permanently with a bilateral phrenicotomy. However, none of these treatments is universally effective for the treatment of hiccups.

Generally, it is more advantageous to use a non-invasive treatment for hiccups, as these methods typically carry less risk and can be as equally effective as invasive treatments involving surgical and pharmaceutical intervention. There is therefore a need for a universal effective, non-invasive treatment for hiccups.

SUMMARY OF THE INVENTION

A system and method for treating hiccups utilizes a filter through which a liquid can only be manually drawn into a user's mouth. In some embodiments, the system includes a receptacle for consuming liquid with a cap or lid that sits on top of, and is operably connected to, the receptacle. The cap includes a drinking aperture to facilitate consumption of liquid from the receptacle. A filter can be positioned to cover the entire open area of the drinking aperture. The filter can comprise a material having pores of a size that prevent a liquid from flowing freely through the filter due to the force of gravity. However, the size of the pores in the filter can also be such that the user can manually draw the liquid into his or her mouth using sucking action to create a partial vacuum that draws the liquid through the filter and into the user's mouth. In this way, a user can eliminate his or her hiccups by engaging his or her mouth with the filter at the drinking aperture, and manually drawing in a liquid from the receptacle, across the filter, into his or her mouth and swallowing the liquid. In some embodiments, the liquid can be water.

In some embodiments, the filter is contained within the cap itself and positioned to cover the entire area of the drinking aperture, such that removal of the cap from the receptacle also removes the filter. In this way, the cap can be applied to a plurality of different receptacles that hold a plurality of different volumes of water. In other embodiments, the filter is separate from the cap and the receptacle, such that the filter can be placed over the receptacle and secured in place by the frictional engagement of the cap connecting to the receptacle. In other embodiments, the filter can be operably connected to, but separate from, the cap and the receptacle. For example, the filter, cap, and receptacle can comprise interlocking or threaded mechanisms for engagement with each other with the filter being a disposable or one-time use element.

As noted above, the cap of the present invention will comprise a hole, or mouth interface, where the user's mouth will interface with the present invention. The filter can be positioned to cover the entire area of the mouth interface, such that when the user engages with the mouth interface and manually draws in liquid from the receptacle, the liquid will flow across the filter and into the user's mouth. The mouth receptacle can be an aperture formed directly in the cap, an extension of the cap, or it can be a separate feature.

In other aspects, the present invention relates to the method of treating hiccups using the materials and methods previously described by drinking a liquid from a receptacle by manually drawing the liquid across a filter and into a user's mouth.

The above summary of the various embodiments of the invention is not intended to describe each illustrated embodiment or every implementation of the invention. This summary represents a simplified overview of certain aspects of the invention to facilitate a basic understanding of the invention and is not intended to identify key or critical elements of the invention or delineate the scope of the invention.

BRIEF DESCRIPTION OF THE DRAWINGS

The invention can be more completely understood in consideration of the following detailed description of various embodiments of the invention in connection with the accompanying drawings, in which:

FIG. 4A is an illustration of a device for treating hiccups according to one embodiment of the present invention.

FIG. 4B is a cross-sectional view of a device for treating hiccups according to one embodiment of the present invention.

FIG. 4C is a cross-sectional view of a device for treating hiccups according to one embodiment of the present invention.

Figure 1:
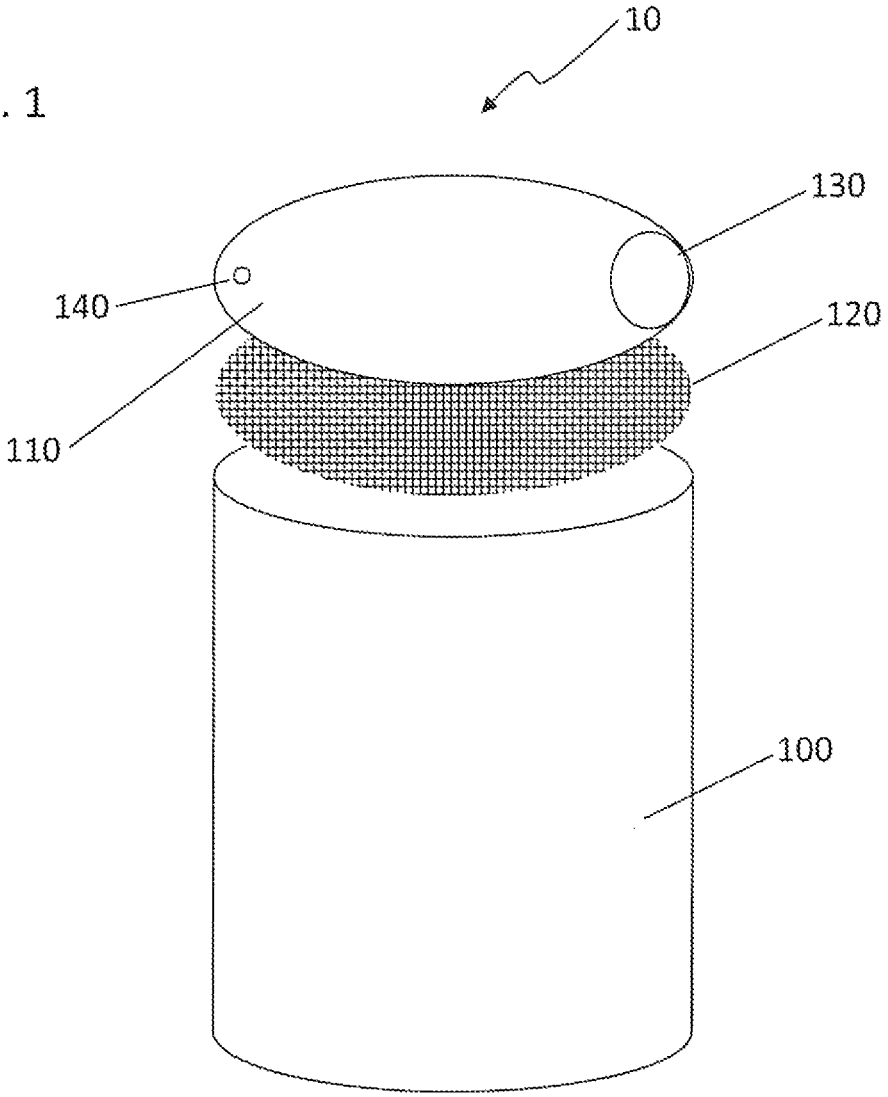
FIG. 1 is an illustration of a device for treating hiccups according to one embodiment of the present invention.

While the invention is amenable to various modifications and alternative forms, specifics thereof have been shown by way of example in the drawings and will be described in detail. It should be understood, however, that the intention is not to limit the invention to the particular embodiments as described. On the contrary, the intention is to cover all modifications, equivalents, and alternatives falling within the spirit and scope of the invention as defined by the appended claims.

DETAILED DESCRIPTION OF THE DRAWINGS

Referring to FIG. 1, a device 10 for treating hiccups according to one embodiment of the present invention can include a receptacle or container 100 for housing a liquid, a cap or lid 110 to prevent spilling of the liquid and to facilitate the flow of the liquid across a filter 120. The receptacle 100 defines an open interior for containing a liquid. The cap further comprises a drinking aperture or mouth interface 130 through which liquid can be drawn from the receptacle 100. The cap 110 can also include an air hole 140. The filter material is generally of a porosity such that liquid does not flow freely through the filter due to the effects of gravity, but must be manually drawn through the by the user sucking the liquid through the filter, thus creating a partial vacuum that draws the liquid through the filter. In one embodiment, the drinking aperture 130 is of a size that the user can directly apply the user's mouth to the filter 120. In another embodiment, the drinking aperture 130 is narrower such that the user's mouth interfaces with the cap 110 and/or receptacle 100 around the filter 120. Such a device may be suitable for treating hiccups in non-elderly adults and non-toddler children.

Figure 2A:
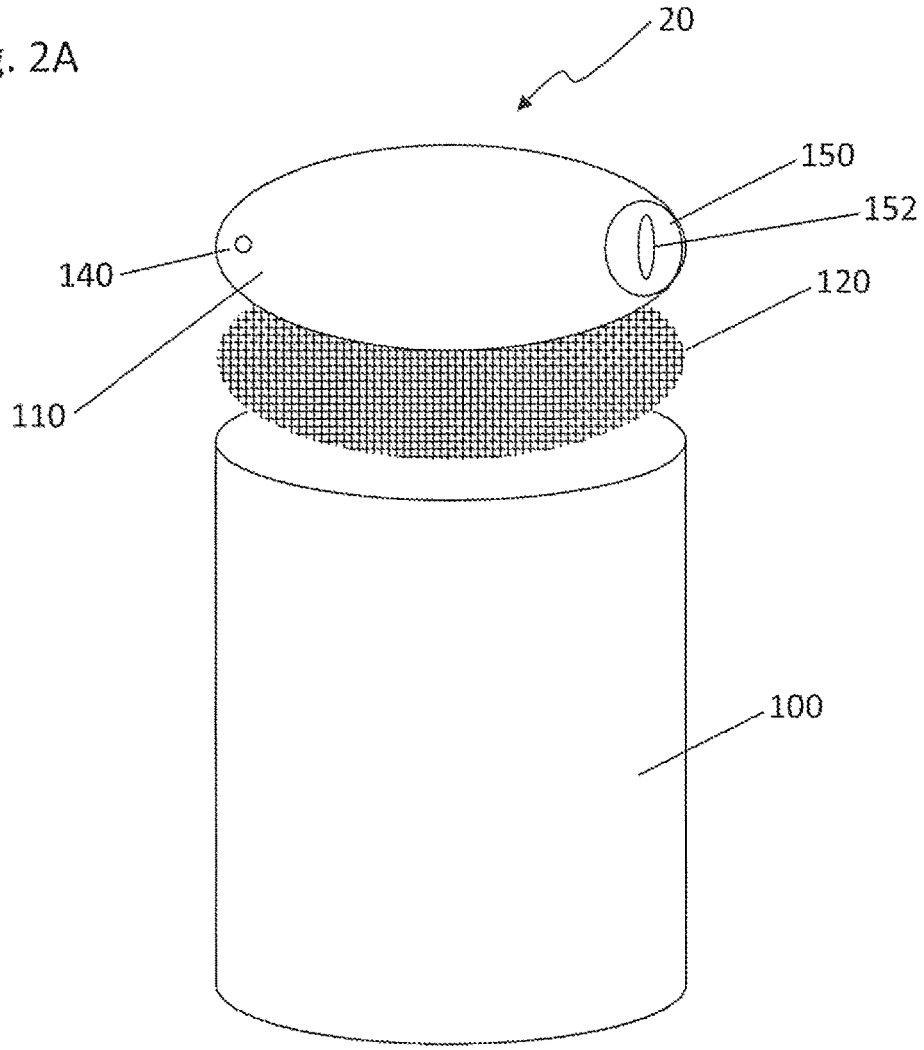
FIG. 2A is an illustration of a device for treating hiccups according to one embodiment of the present invention.
Figure 2B:
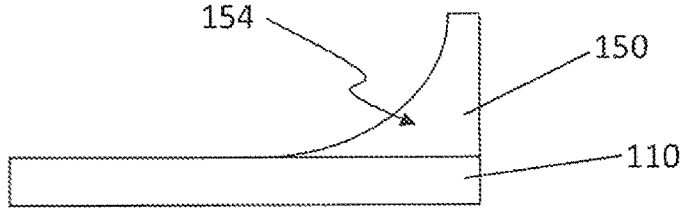
FIG. 2B depicts a side view of the device of FIG. 2A.

FIGS. 2A and 2B depict another embodiment of a device 20 for treating hiccups according to an embodiment of the invention. Device 20 also includes a receptacle 100 for housing a liquid, a cap 110 to prevent spilling of the liquid, a filter 120 and an air hole 140. The mouth interface 150 of device 20 can be raised from the upper surface of the lid. As illustrated in FIGS. 2A and 2B, the mouth interface 150 can comprise a raised body 154 with a narrow opening 152 or slit of the type commonly used by toddlers (i.e., "sippy" cups) so that the toddler can consume the liquid without spilling. As shown in FIG. 2A, the filter 120 can be located at an upper surface of the receptacle 100, and the vacuum force created by the user sucking at the mouth interface 150 can be used to draw the liquid across the filter 120. In other embodiments, the filter 120 can be located closer to the drinking opening 152, such as by being positioned within the body 154 of the mouth interface such that a lower vacuum force is necessary to draw the liquid through the filter. Such a device may be suitable for treating hiccups in toddlers and the elderly.

Figure 3:
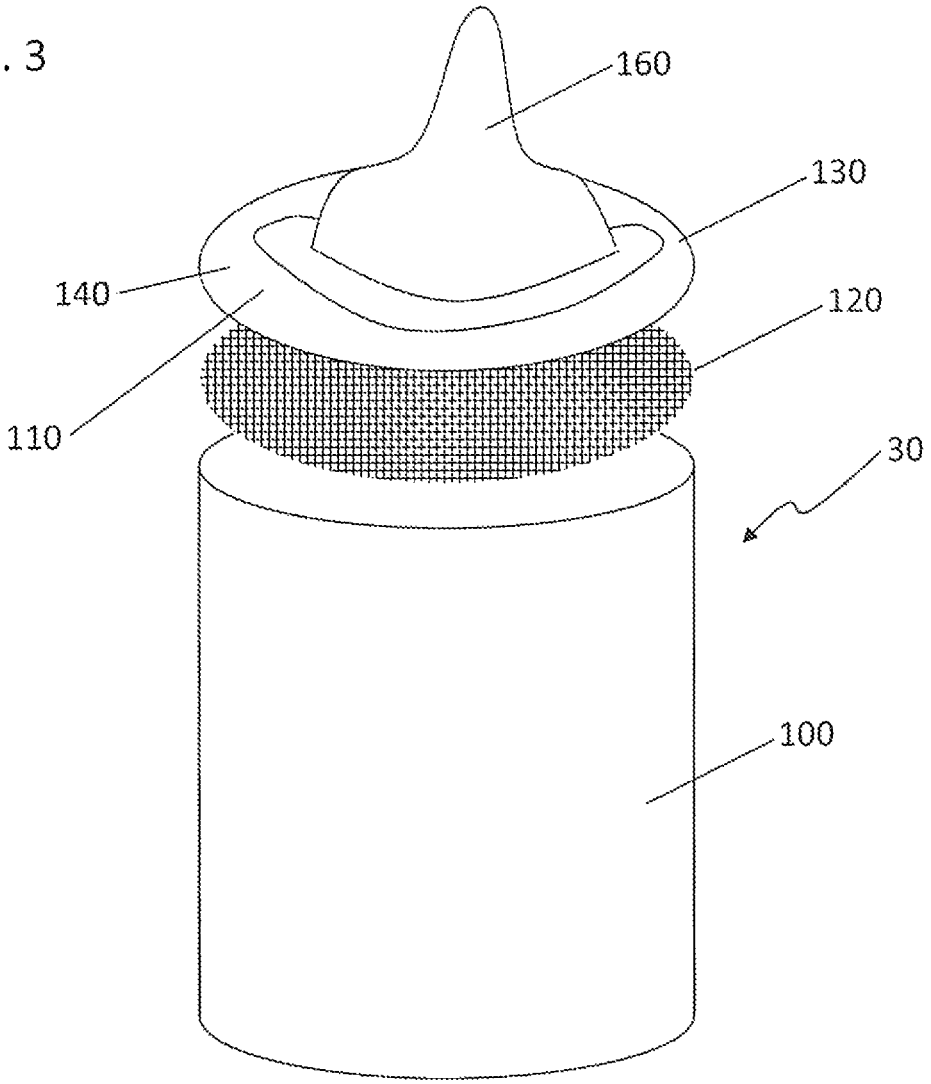
FIG. 3 is an illustration of a device for treating hiccups according to one embodiment of the present invention.

FIG. 3 illustrates a device 30 for treating hiccups according to another embodiment of the present invention. Device 30 generally comprises a receptacle 100 for housing a liquid, a cap 110 to prevent spilling of the liquid and a filter 120. The cap further comprises a mouth interface 160 in the shape of a nipple. As illustrated in this embodiment, the mouth interface 160 can comprise a raised nipple of the type commonly used by infants so that the infant consumes the liquid using a sucking action. As with the previous embodiment, the filter 120 can be located at an upper surface of the receptacle 100 or can be positioned within the nipple 160 itself. Such a device may be suitable for treating hiccups in infants.

Figure 5A:
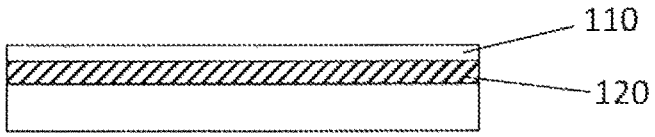
FIG. 5A is a cross-sectional view of a device for treating hiccups according to one embodiment of the present invention.

FIG. 4A depicts a device 40 for treating hiccups according to a further embodiment of the invention that includes a receptacle 100 for housing a liquid, a cap 110 to prevent spilling of the liquid and a filter 120. In this embodiment, the cap 110 can comprise a filter 120 that is contained within the cap 110, such that the filter 120 is positioned to cover the entire area of the mouth interface 140. In such an embodiment, the filter 120 can be removeably positioned in the cap 110 such that the cap 110 can be reused with new filters 120. Alternatively, the cap 110 itself can be considered disposable such that new caps 110 with built-in filters 120 can be used with receptacle 100. In such an embodiment, the filter 120 can be fixedly attached to the lid 110 as shown in FIG. 4B such as by, for example, an adhesive or a fastener such as a staple. The filter 120 can also be captured between upper and lower surfaces of the cap as shown in FIG. 4C, which each of the upper and lower surfaces having a drinking opening 140 in alignment with each other. FIG. 5A depicts a cross-sectional view of such a cap 110 in which the filter 120 is integrally attached to the cap 110.

The receptacle, filter, and cap can be comprised of a plurality of materials, including, but not limited to, plastics, rubber, metals, glass, as well as any synthetic polymers. In one embodiment, the filter 120 is comprised of a paper material, such as a paper napkin. For example, the filter can have pores that measure any size between about 0.2 microns and about 5.0 microns. In some embodiments, the filter can consist of pores that measure between about 0.2 microns and about 1.0 microns. In some embodiments, the filter can consist of pores that measure between about 0.5 microns and about 1.0 microns. In some embodiments, the filter can consist of pores that measure between about 1.0 microns and about 5.0 microns. Other pore sizes can also be used to eliminate hiccups in the manner of the present invention.

Pore size can be selected based on the liquid that is used such that the particular liquid will not freely flow through the material but will flow through when a partial vacuum is applied with a user's mouth. With a tilter comprised of a tearable material such as the paper material described above, after a liquid such as water has contacted the material for a period of time the paper will become saturated and will eventually tear or break due to a combination of a weakening of the material and a force of the liquid against the filter. Thus, although the liquid will not flow through the material itself, eventually the material will tear from being saturated with the liquid forming an opening through the material though which the liquid can flow. Filters comprised of such materials are therefore limited or one-time use filters that must be disposed of and replaced after a single use or a limited number of uses. It should therefore be apparent that in the context of the present application when the liquid is referred to as being sucked through the material, that this refers to the material being in a solid state and the material going through the fabric/pores of the material, not through a large opening created in the material such that the user would essentially be ingesting a free flowing liquid.

Figure 5B:
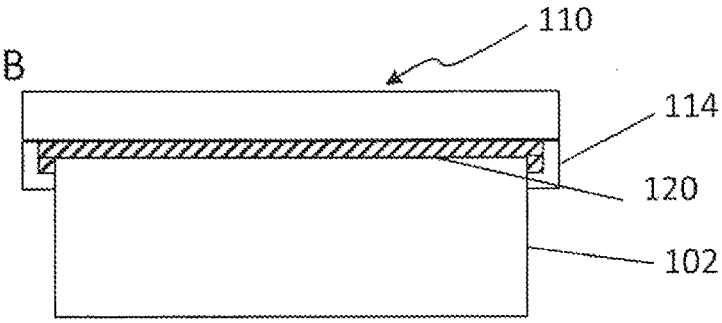
FIG. 5B is a cross-sectional view of a device for treating hiccups according to one embodiment of the present invention.

Caps or lids 110 can be operably connected to an upper rim of the receptacle 100 to prevent a liquid from exiting the open interior of the receptacle, except through the mouth interface and corresponding opening. Operably connected can include interlocking, such as by a snap fit or interference fit of a downwardly extending skirt 114 of cap 110 over an outer surface 102 of the receptacle 100 as shown in FIG. 5B, or threaded mechanisms for engagement with each other (not pictured). The cap 110 can also be connected to the receptacle 100 be resting a flat cap 110 on an upper surface of the receptacle 100 such as depicted in FIGS. 1-4A.

In each of the embodiments shown in FIGS. 1-3, the filter 120 is positioned to cover the entire area of the mouth interface, and extends across the entire opening of the receptacle 100. As shown in FIGS. 1-4A, the filter 120 can have a shape generally matching the shape of the cap 110 and receptacle 100 with which it is used. However, the filter does not need to have such a matching shape. As noted above, generally the filter 120 comprises pores of a size that prevent a liquid from flowing freely out of the mouth interface due to the force of gravity. The size of the pores in the filter can be such that the user is required to manually draw the liquid into his or her mouth using sucking action in order for the liquid to exit the receptacle 100 and enter the user's mouth. In this way, a user can eliminate his or her hiccups by engaging his or her mouth with the mouth interface, and manually drawing in a liquid from the receptacle, across the filter, into his or her mouth and swallowing the liquid.

Figure 5C:
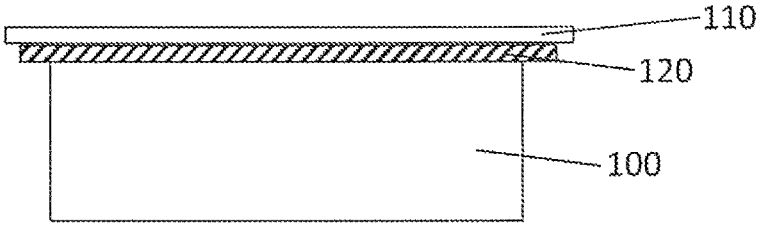
FIG. 5C is a cross-sectional view of a device for treating hiccups according to one embodiment of the present invention.

In some embodiments, the present invention comprises a filter 120 that is separate from the cap 120 and the receptacle 100. The filter 120 can be larger than an opening of the receptacle 100 such that when the cap 110 is placed over the receptacle 100, securing a skirt 114 of the cap over an outer surface 102 of the receptacle captures a portion 122 of the filter 120 between the cap 110 and the receptacle 102 as shown in FIG. 5B. Alternatively, a filter 120 that is larger than the opening of the receptacle 100 can be held in place by force applied to the lid 110 by the user in a configuration such as is shown in FIG. 5C.

Figure 5D:
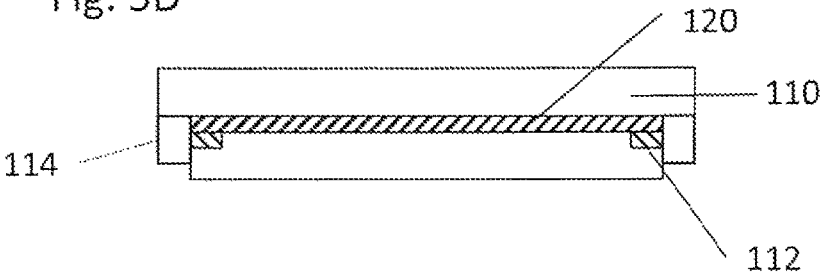
FIG. 5D is a cross-sectional view of a device for treating hiccups according to one embodiment of the present invention.
Figure 5E:
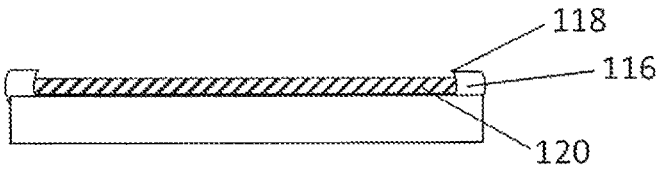
FIG. 5E is a cross-sectional view of a device for treating hiccups according to one embodiment of the present invention.

In other embodiments, the filter 120 can be operably connected to, but separate from, the cap 110 and the receptacle 100. For example, the filter, cap, and receptacle can comprise interlocking or threaded mechanisms for engagement with each other. As shown in FIG. 4C, the filter 120 can be captured between upper and lower surfaces of the lid 110. In one embodiment shown in FIG. 5D, the lid 110 can include an annular rim 112 extending around the circumference of the inner surface of the skirt 114. In such an embodiment, the filter 120 can be forced up into the lid 110 and, because it is made of a flexible material, deform slightly to travel past the rim 112. The filter 120 with then rest upon the rim 112 within the lid 110. In a further embodiment depicted in FIG. 5E, the lid 110 can include an upwardly extending skirt 116 in which the filter 120 is retained. In such an embodiment, the filter 120 can be retained either by a frictional force with the inner surface of the skirt 116, pressure applied by the user's hand to retain the filter 120 against the upper surface of the lid or by an annular lip 118 extending from the skirt 120. Each of these embodiments can be utilized with a disposable filter 120 such that the lid 110 and receptacle 100 can be reused with additional filters. In certain embodiments, the lid 110 can be provided in standard sizes such that it can be used with a variety of different receptacles. Alternatively, a disposable filter 120 and lid 110 combination could utilize any of the above depicted structures.

Figure 6A:
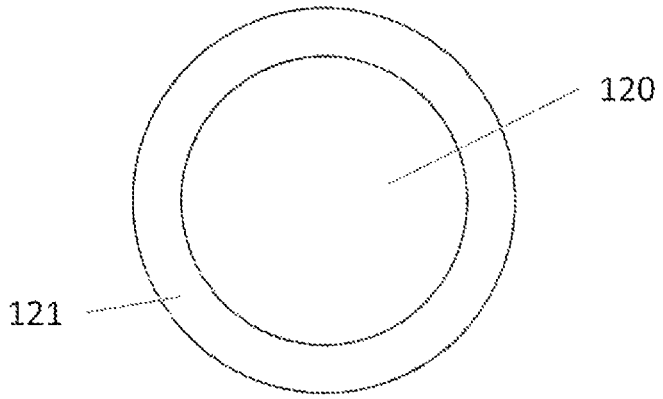
FIG. 6A is a plan view of a filter for a device for treating hiccups according to one embodiment of the present invention.
Figure 6B:
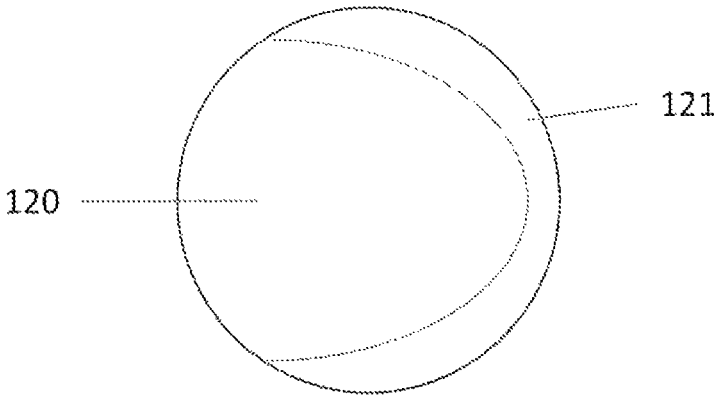
FIG. 6B is a plan view of a filter for a device for treating hiccups according to one embodiment of the present invention.

Although filter 120 is depicted in FIGS. 1-3 as comprising solid filter material and extending the full circumference of the receptacle 100 or greater, it should be understood that variations on the construction of the filter are within the scope of the invention. The filter 120 need only extend a sufficient amount to cover the drinking opening in the particular lid. For example, in the embodiment shown in FIG. 4B having a filter 120 that is integrally formed with the lid 110, the filter may be sized to be just larger than the opening 140 so that it can be affixed to an inner surface of the lid 110 rather than extending the full area of the lid 110. The filter 120 can also include materials other than the filter material. For example, the filter 120 can include an outer circumferential rim 121 made of a material such as plastic or rubber with the filter material extending across an opening formed by the rim to provide greater structural rigidity to the filter 120. The outer circumferential rim 121 may completely surround the filter material as shown in FIG. 6A or may extend only partially around the filter material as shown in FIG. 6B, in order to leave one end comprised of only filter material for easy alignment with various configured drinking openings. Such an embodiment is particularly useful in embodiments utilizing a disposable or one-time use only filter, as the increased structural rigidity aids in removal of a used filter from a cap and insertion of a new filter into the cap.

In one embodiment, the mouth interface will comprise a straw extending from outside the receptacle to inside the receptacle. The straw can include an internal filter positioned within the straw. The vacuum force created to force the liquid through the filter is therefore facilitated by the straw.

As described in the embodiments above, the ideal mouth interface or drinking opening can be of a type that reflects the user's developmental age. For example, the mouth interface can be a nipple, such that a liquid can be consumed through a filter by an infant. Additionally, the mouth interface can be a raised extension of the cap, comprising a raised narrow slit or opening, such that a liquid can be consumed by toddler (e.g., a "sippy" cup). In some embodiments, the mouth interface can be comprised of a separate material and be detachable from the cap, to promote increased hygiene and easier replaceability of the filter.

In certain embodiments, the receptacle of the present invention can have various features that enhance its effectiveness for treating hiccups. In some embodiments, the receptacle can be collapsible, such that the user can easily store and transport it in a purse or bag or other container. The receptacle can also be of a size that facilitates the treatment of hiccups for a specific user. For example, some users may need to manually draw in more liquid than other users to treat their hiccups. In some cases, the receptacle can hold at least about 8 or more ounces of liquid, including 12, 16, or 20 ounce containers. In other embodiments, the user may need a receptacle that holds less than 8 ounces of water, such that 6, 4, or 2 ounce containers are provided. In some embodiments, the receptacle can be lined with an insulated material that enables the user to keep the liquid at a certain temperature. For example, the user can use a receptacle comprising an insulating layer, such that the water is kept between, for example, 0 and 15 degrees Celsius.

A method for treating hiccups of the present invention involves consuming a liquid from a device such as described herein incorporating a filter material through which a liquid such as water will not naturally flow due to the effects of gravity. The user must suck the liquid to create a partial vacuum that draws the liquid through the filter and swallow the liquid. In one embodiment, the user intakes liquid for a period of at least 5 seconds. Applicant believes that forcing the liquid through the filter changes the properties of the liquid, such as water, such that the altered liquid contacting the diaphragm and/or the sucking action required to draw the liquid through the filter alters the user's breathing, thereby eliminating the hiccups. In the case of water, Applicant believes that the $H_2O$ molecules are affected when passing through the filter such that a different combination of hydrogen and oxygen molecules contact and affect the diaphragm to eliminate the hiccups.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

What is claimed is:

1. A device for treating hiccups, comprising:

a receptacle including an open interior for housing a liquid;

a cap adapted to be operably connected to the receptacle, the cap defining at least one opening providing for passage of liquid from the open interior of the receptacle to an exterior of the receptacle; and only a single filtering element comprising a replaceable filter including a filter material adapted to be positioned between the open interior of the receptacle and all of the opening in the cap directly adjacent the opening in the cap, the filter material comprising only a solid paper material that will not allow liquid to naturally and freely flow therethrough due to the effects of gravity requiring a user to create a partial vacuum with the user's mouth at the filter material to draw the liquid across the paper material, and wherein, after the paper material is saturated with the liquid the paper material will tear from the force of the liquid against the paper material, and wherein the replaceable filter is adapted to be physically retained by and contacting a portion of the cap and a portion of a body of the receptacle, and wherein the paper material has a pore size between about 0.2 and about 5.0 microns.

2. The device of claim 1, wherein the cap includes a downwardly extending skirt adapted to attach to an upper portion of the receptacle, and wherein the replaceable filter is captured between the skirt and the receptacle.

3. The device of claim 1, wherein the filter material is fixedly attached to the cap.

4. The device of claim 1, wherein the replaceable filter is retained within the cap.

5. A device for treating hiccups, comprising:

a receptacle including an open interior for housing a liquid;

a cap adapted to be operably connected to the receptacle, the cap defining at least one opening providing for passage of liquid from the open interior of the receptacle to an exterior of the receptacle; and a replaceable filter including a filter material adapted to be positioned between the open interior of the receptacle and all of the opening in the cap directly adjacent the opening in the cap, the filter material comprising only a solid paper material that will not allow liquid to naturally and freely flow therethrough due to the effects of gravity requiring a user to create a partial vacuum with the user's mouth at the filter material to draw the liquid across the paper material, and wherein, after the paper material is saturated with the liquid the paper material will tear from the force of the liquid against the paper material, and wherein the replaceable filter is physically retained by and contacting opposing upper and lower surfaces of the cap, and wherein the paper material has a pore size between about 0.2 and about 5.0 microns.

6. The device of claim 1, wherein the filter further includes an outer rim comprised of a solid material extending at least partially around the filter material.

7. The device of claim 1, wherein the opening is defined within one of the group consisting of: a body of the cap, a structure extending upwardly from the cap, and a nipple.

8. The device of claim 5, wherein the filter material is fixedly attached to the cap.

9. The device of claim 5, wherein the replaceable filter is retained within the cap.

10. The device of claim 5, wherein the filter further includes an outer rim comprised of a solid material extending at least partially around the filter material.

11. The device of claim 5, wherein the opening is defined within one of the group consisting of: a body of the cap, a structure extending upwardly from the cap, and a nipple.

12. A device for treating hiccups, comprising:

a receptacle including an open interior for housing a liquid;

a cap adapted to be operably connected to the receptacle, the cap defining at least one opening providing for passage of liquid from the open interior of the receptacle to an exterior of the receptacle; and a replaceable filter including a filter material adapted to be positioned between the open interior of the receptacle and all of the opening in the cap directly adjacent the opening in the cap, the filter material comprising only a solid paper material that will not allow liquid to naturally and freely flow therethrough due to the effects of gravity requiring a user to create a partial vacuum with the user's mouth at the filter material to draw the liquid across the paper material, and wherein, after the paper material is saturated with the liquid the paper material will tear from the force of the liquid against the paper material, wherein the paper material has a pore size between about 0.2 and about 5.0 microns.

13. The device of claim 12, wherein the filter material is fixedly attached to the cap.

14. The device of claim 12, wherein the replaceable filter is retained within the cap.

15. The device of claim 12, wherein the filter further includes an outer rim comprised of a solid material extending at least partially around the filter material.

16. The device of claim 12, wherein the opening is defined within one of the group consisting of: a body of the cap, a structure extending upwardly from the cap, and a nipple.

* * * * *